US012774815B2

(12) United States Patent
Lee et al.

(10) Patent No.: US 12,774,815 B2
(45) Date of Patent: Oct. 27, 2026

(54) COOKING APPLIANCE

(71) Applicant: Samsung Electronics Co., Ltd., Suwon-si (KR)

(72) Inventors: Changhyun Lee, Suwon-si (KR); Sangjin Jeong, Suwon-si (KR); Yesil Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 409 days.

(21) Appl. No.: 18/504,055

(22) Filed: Nov. 7, 2023

(65) Prior Publication Data

US 2024/0077209 A1 Mar. 7, 2024

Related U.S. Application Data

(63) Continuation of application No. PCT/KR2022/008545, filed on Jun. 16, 2022.

(30) Foreign Application Priority Data

Jul. 2, 2021 (KR) ..... 10-2021-0087066
Jul. 26, 2021 (KR) ..... 10-2021-0097943

(51) Int. Cl.
*F24C 15/08* (2006.01)

(52) U.S. Cl.
CPC ..... *F24C 15/08* (2013.01)

(58) Field of Classification Search
CPC ..... F24C 15/08
USPC ..... 126/1 R
See application file for complete search history.

(56) References Cited

U.S. PATENT DOCUMENTS 3,145,289 A * 8/1964 Swetlitz ..... F24C 15/08 126/39 M
4,092,698 A * 5/1978 Brefka ..... G01R 1/04 361/752
4,149,217 A * 4/1979 Tucker ..... H05B 6/062 345/173

(Continued)

FOREIGN PATENT DOCUMENTS

JP 2002-317943 A 10/2002
KR 10-1998-0074664 A 11/1998

(Continued)

OTHER PUBLICATIONS

International Search Report and Written Opinion of the International Searching Authority dated Sep. 30, 2022, in connection with International Application No. PCT/KR2022/008545, 7 pages.

(Continued)

*Primary Examiner* — Avinash A Savani

(57) ABSTRACT

The present disclosure relates to a cooking apparatus. The cooking apparatus includes a main body, and a control unit provided in front of the main body, wherein the control unit includes a case mounted on a front side of the main body and having an open rear side to communicate with an inside of the main body, a bracket panel accommodated in a rear side of an inside of the case, a protrusion extending from an inner surface of the case toward the bracket panel, and a fixing rib formed on a surface of the bracket panel to allow the protrusion of the case to be inserted and extending inward from an inner surface of the bracket panel to cover a rear side of the protrusion.

20 Claims, 20 Drawing Sheets

(56) References Cited

U.S. PATENT DOCUMENTS

| | | | | |
|---|---|---|---|---|
| 4,336,569 | A * | 6/1982 | Tsuda | F24C 7/082 361/752 |
| 7,026,589 | B2 * | 4/2006 | Kim | H05B 6/6435 219/702 |
| 8,908,382 | B2 | 12/2014 | Lee et al. | |
| 11,175,038 | B2 * | 11/2021 | Fox | F24C 3/085 |
| 2019/0120499 | A1 | 4/2019 | Kim | |

FOREIGN PATENT DOCUMENTS

| | | | |
|---|---|---|---|
| KR | 10-1999-0039068 | A | 6/1999 |
| KR | 20-2000-0004451 | U | 3/2000 |
| KR | 20-2000-0008739 | U | 5/2000 |
| KR | 20-0194103 | Y1 | 6/2000 |
| KR | 20-2000-0015602 | U | 8/2000 |
| KR | 10-2002-0034445 | A | 5/2002 |
| KR | 10-2003-0080776 | A | 10/2003 |
| KR | 10-2004-0061362 | A | 7/2004 |
| KR | 10-2005-0005024 | A | 1/2005 |
| KR | 10-2005-0010564 | A | 1/2005 |
| KR | 10-2005-0100180 | A | 10/2005 |
| KR | 10-2006-0009598 | A | 2/2006 |
| KR | 10-2006-0013842 | A | 2/2006 |
| KR | 10-2007-0015282 | A | 2/2007 |
| KR | 10-2007-0081856 | A | 8/2007 |
| KR | 10-2009-0082624 | A | 7/2009 |
| KR | 10-0988094 | B1 | 10/2010 |
| KR | 10-0995185 | B1 | 11/2010 |
| KR | 10-1377919 | B1 | 3/2014 |
| KR | 10-2015-0062578 | A | 6/2015 |
| WO | 2018207441 | A1 | 11/2018 |

OTHER PUBLICATIONS

Notice of Allowance dated May 26, 2025, in connection with Korean Application No. 10-2021-0097943, 3 pages.

* cited by examiner

COOKING APPLIANCE

CROSS-REFERENCE TO RELATED APPLICATIONS

This application is a Bypass Continuation of International Application No. PCT/KR2022/008545, filed Jun. 16, 2022, which claims priority to Korean Patent Application No. 10-2021-0087066, filed Jul. 2, 2021, and Korean Patent Application No. 10-2021-0097943, filed Jul. 26, 2021, the disclosures of which are herein incorporated by reference in their entirety.

BACKGROUND

1. Field

The present disclosure relates to a cooking apparatus having an improved structure, and more particularly, to a cooking apparatus having a control unit of an improved structure.

2. Description of Related Art

A cooking apparatus is an apparatus for cooking by heating a cooking object such as food, and refers to an apparatus capable of providing various functions related to cooking, such as heating, thawing, drying, and sterilization of a cooking object. As such a cooking apparatus, there are, for example, an oven such as a gas oven and an electric oven, a microwave heating device (hereinafter referred to as a microwave oven), a gas range, an electric range, a hood combined microwave oven (Over the Range; OTR), a gas grill or an electric grill, and the like.

The Over the Range is a microwave oven with a hood function that is responsible for ventilation in a kitchen, in which an installation space is minimized while cooking food more conveniently and efficiently. This Over the Range may be located above a cooking apparatus such as a gas range and a cooktop.

A cooking apparatus may include a control unit on which a circuit board is mounted to electronically control the cooking apparatus. The control unit may include a case forming an exterior, and a bracket panel provided at the rear of the case to protect the circuit board from the outside and block moisture inflow.

However, when a fire occurs inside the cooking apparatus and internal flame spreads to the outside of the cooking apparatus through the control unit, a more serious safety accident may occur.

SUMMARY

The present disclosure is directed to providing a cooking apparatus capable of preventing a fire from spreading to the outside when the fire occurs inside the cooking apparatus.

The present disclosure is directed to providing a cooking apparatus having an improved structure of a bracket panel disposed inside a case of a control unit so that internal flame is not exposed to the outside.

An aspect of the present disclosure provides a cooking apparatus including a main body, and a control unit provided in front of the main body, wherein the control unit includes a case mounted on a front side of the main body and having an open rear side to communicate with an inside of the main body, a bracket panel accommodated in a rear side of an inside of the case, a protrusion extending from an inner surface of the case toward the bracket panel, and a fixing rib formed on a surface of the bracket panel to allow the protrusion of the case to be inserted and extending inward from an inner surface of the bracket panel to cover a rear side of the protrusion.

The fixing rib may include a blocking portion provided to face the inside of the main body so as to cover the rear side of the protrusion.

The fixing rib may further include a connecting portion connected to both ends of the blocking portion and connected to an inner surface of the bracket panel.

The bracket panel may include a cutout hole formed at a front end of the blocking portion to communicate with the case.

The blocking portion may extend to incline forward from an inner side of a side wall of the bracket panel.

The fixing rib may be pressed inward from a side wall of the bracket panel through lancing processing.

The bracket panel may include a board accommodating frame in which a circuit board is accommodated, and a coupling flange extending upward from the board accommodating frame to couple with the case.

The board accommodating frame may include a frame body provided parallel to a rear surface of the case and having a boss passing hole through which a board coupling boss extending to the rear of the case passes.

The board coupling boss passed through the boss passing hole may be provided to be screwed with the circuit board.

The main body may include a front plate comprising an opening communicating with a cooking chamber and a communication portion communicating with an electrical equipment room.

The case and the bracket panel may be coupled to the front of the communication portion of the front plate to cover the communication portion.

The electrical equipment room in which a cooling fan provided to form a cooling flow path is disposed may be provided at a rear side of the communication portion.

The bracket panel may be provided to cover the front of the communication portion and be disposed between the electrical equipment room and the case to partition the case and the electrical equipment room.

The case may include a resin material, and the bracket panel may include a steel material.

The case may prevent a movement of the bracket panel by inserting the protrusion into an outer side of the fixing rib of the bracket panel.

Another aspect of the present disclosure provides a cooking apparatus including a main body, and a control unit provided in front of the main body, wherein the control unit includes a case mounted on a front side of the main body and having an open rear side to communicate with an inside of the main body, a circuit board, a bracket panel mounted to a rear side of an inside of the case to accommodate the circuit board, a fixing rib extending rearward from an inner surface of the bracket panel toward the case to protrude outward of the bracket panel, and a cutout hole formed between the fixing rib and an outer surface of the bracket panel.

The case may include a rib accommodating groove formed to be recessed from an inner surface thereof to accommodate an end of the fixing rib.

The fixing rib may be pressed outward from a side wall of the bracket panel through lancing processing.

Another aspect of the present disclosure provides a cooking apparatus including a main body including an electrical equipment room, and a control unit mounted on a front side of the main body to communicate with the electrical equipment room from a rear side thereof, wherein the control unit includes a case forming an exterior and having a protrusion on an inner surface thereof, a bracket panel accommodated in the case and including a cutout hole into which the protrusion is inserted, and a fixing rib formed by being pressed inward from a side of the bracket panel and including a blocking portion provided to be inclined toward the front side of the main body from an inner surface of the bracket panel to form a space into which the protrusion is inserted.

The cutout hole may be formed at a front end of the blocking portion.

According to the present disclosure, a blocking portion is formed at a portion where a case is inserted into a bracket panel, so that a flame occurred inside a main body can be blocked through the blocking portion.

According to the present disclosure, a fixing rib is lanced such that a cutout hole communicating the case and the bracket panel does not face an electrical equipment room, so that a fire can be prevented from spreading to the case through the cutout hole.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
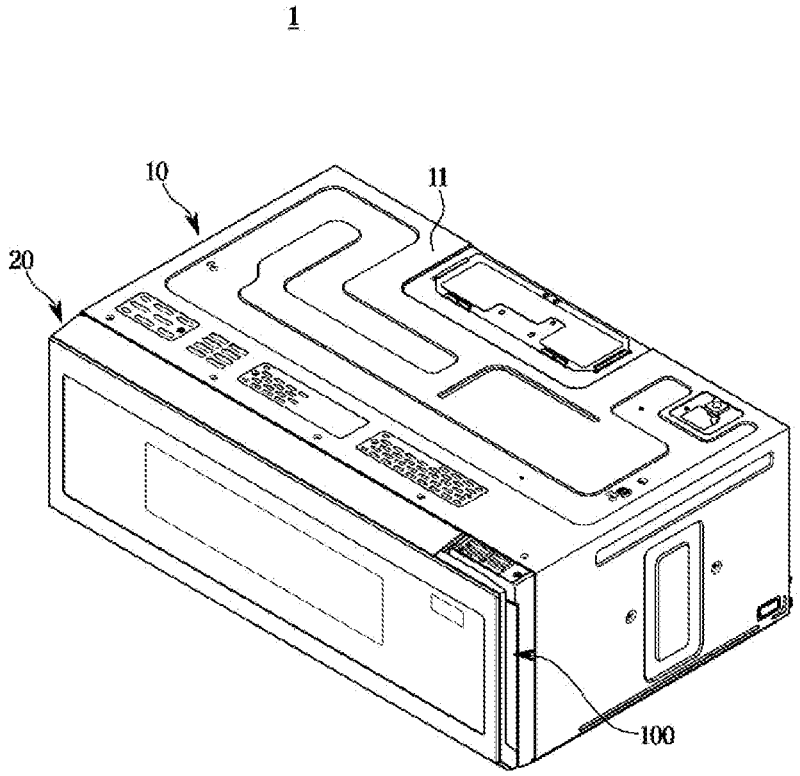
FIG. 1 is a perspective view of a cooking apparatus according to an embodiment of the present disclosure.

FIGS. 1 through 20, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms first, second, etc. may be used herein to describe various components, these components should not be limited by these terms, the terms are only used to distinguish one component from another. For example, without departing from the scope of the present disclosure, a first component may be referred to as a second component, and similarly, the second component may also be referred to as a first component. The term_"and/or" includes any combination of a plurality of related items or any one of a plurality of related items.

Hereinafter, embodiments of the present disclosure will be described in detail with reference to the accompanying drawings.

Figure 2:
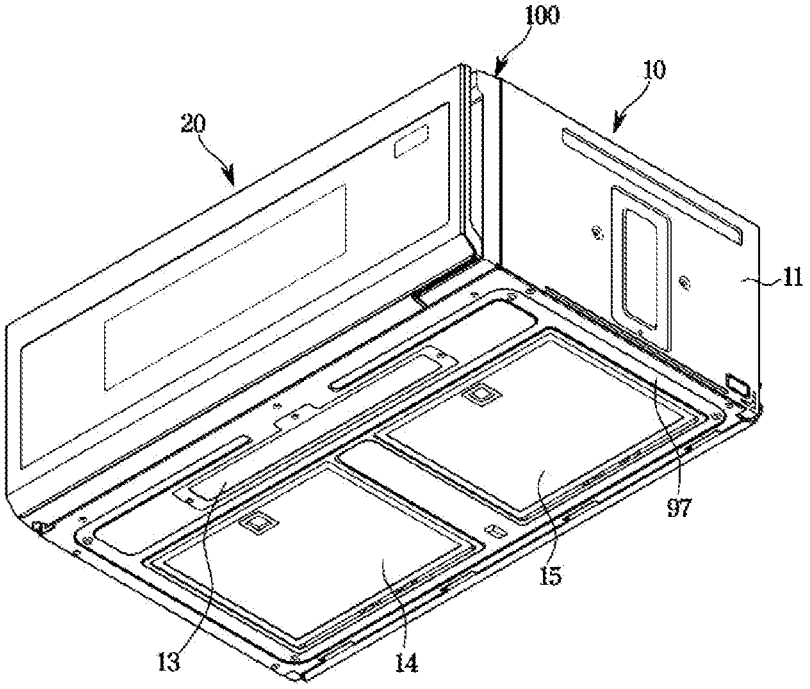
FIG. 2 is a bottom perspective view of the cooking apparatus according to an embodiment of the present disclosure.
Figure 3:
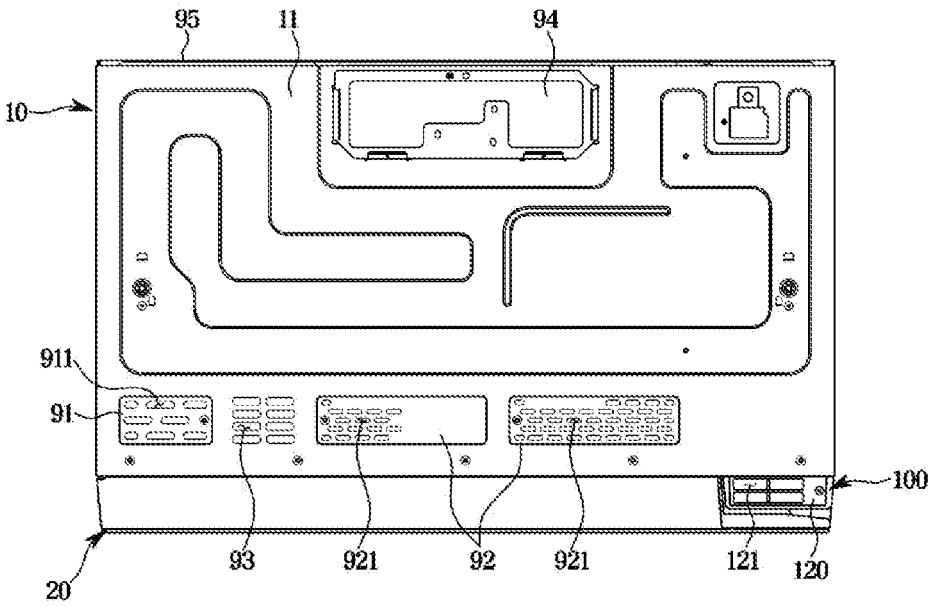
FIG. 3 is a top view of the cooking apparatus according to an embodiment of the present disclosure.

FIG. 1 is a perspective view of a cooking apparatus according to an embodiment of the present disclosure. FIG. 2 is a bottom perspective view of the cooking apparatus according to an embodiment of the present disclosure. FIG. 3 is a top view of the cooking apparatus according to an embodiment of the present disclosure.

A cooking apparatus 1 according to an embodiment of the present disclosure may be provided as a hood combined microwave oven (OTR). Hereinafter, the OTR will be described as the cooking apparatus 1.

Referring to FIGS. 1 to 3, the cooking apparatus 1 may include a main body 10 and a door 20 coupled to the front of the main body 10.

The cooking apparatus 1 may include a control unit 100 coupled to the front of the main body 10. The front of the control unit 100 may be covered by the door 20. More specifically, the control unit 100 may be coupled to the main body 10 to be disposed between the door 20 and the main body 10.

The door 20 may cover the front of the control unit 100 by recessing a portion of the rear of the door 20.

A first circulation air intake part 14 and a second circulation air intake part 15 may be formed on a lower surface of the main body 10. More specifically, the first circulation air intake part 14 and the second circulation air intake part 15 may be formed on a bottom plate 97 of the main body 10.

Oil vapor or the like formed below the cooking apparatus 1 may be drawn into the cooking apparatus 1 through the first circulation air intake part 14 and the second circulation air intake part 15. More specifically, the first circulation air intake part 14 may include a first circulation air intake port. The second circulation air intake part 15 may include a second circulation air intake port. The drawn oil vapor may be filtered out by a filter (not shown) inside the cooking apparatus 1 and discharged to the outside of the cooking apparatus 1. A detailed description of this circulation flow path will be given later.

The main body 10 may include a lighting unit 13. The lighting unit 13 may be disposed in front of the first circulation air intake part 14 and the second circulation air intake part 15. The lighting unit 13 may be provided to emit light to a lower side of the cooking apparatus 1 when a cooktop or the like is installed below the cooking apparatus 1.

A service panel 91 and a discharge panel 92 may be disposed on an upper surface of the main body 10. Specifically, the service panel 91 may be detachably provided on an upper surface of an outer housing 11. The discharge panel 92 may be detachably provided on the upper surface of the outer housing 11.

A ventilation duct panel 94 may be disposed on the upper surface of the main body 10. The ventilation duct panel 94 may be detachably mounted to the outer housing 11.

Although the discharge panel 92 according to an embodiment of the present disclosure is illustrated as being formed of two, the number of discharge panels 92 is not limited thereto.

The service panel 91 may include a first circulation air discharge hole 911. Each of the discharge panels 92 may include a second circulation air discharge hole 921.

Contaminated air introduced into the main body 10 through the first circulation air intake part 14 and the second circulation air intake part 15 formed on the lower surface of the main body 10 may be filtered out and discharged to the outside of the cooking apparatus 1 through the first circulation air discharge hole 911 and the second circulation air discharge hole 921.

In the cooking apparatus 1 according to an embodiment of the present disclosure described above, it has been described that the first circulation air discharge hole 911 and the second circulation air discharge hole 921 are formed on the service panel 91 and the discharge panel 92, and the filtered air is discharged into a room through an upper surface of the cooking apparatus 1.

However, the present disclosure is not limited thereto, and when a separate communication duct (not shown) connected to the outside of the room is provided in a space where the cooking apparatus 1 is mounted, the service panel 91 may not include the first circulation air discharge hole 911 and the discharge panel 92 may also not include the second circulation air discharge hole 921.

Instead, a circulation air discharge hole may be formed on the ventilation duct panel 94. In this case, the oil vapor introduced into the first circulation air intake port and the second circulation air intake port may be filtered out, flow to the communication duct through the ventilation duct panel 94 on a rear upper surface of the cooking apparatus 1, and be discharged to the outside of the room.

In other words, as the circulation air discharge hole is formed on the ventilation duct panel 94 while the first circulation air discharge hole 911 is not formed on the service panel 91 and the second circulation air discharge hole 921 is not formed on the discharge panel 92, the filtered oil vapor is not discharged into the room but may be discharged to the outside of the room.

Through this, the air in the room may be kept cleaner, and cooling air introduced through a cooling flow path C, which will be described later, has a lower temperature, so that cooling efficiency of the cooking apparatus 1 may be increased.

Because the service panel 91, the discharge panel 92, and the ventilation duct panel 94 are detachably provided on the outer housing 11, mounting the service panel 91, the discharge panel 92, and the ventilation duct panel 94 to the outer housing 11 may be as needed.

Specifically, when the separate communication duct (not shown) is not provided and the filtered air needs to be discharged into the room, the service panel 91 and the discharge panel 92 on which the circulation air discharge holes are formed may be mounted on the outer housing 11, and the ventilation duct panel 94 on which the circulation air discharge hole is not formed may be mounted on the outer housing 11.

Conversely, when the separate communication duct (not shown) is provided and the filtered air does not need to be discharged into the room, the service panel 91 and the discharge panel 92 on which the circulation air discharge holes are not formed may be mounted on the outer housing 11, and the ventilation duct panel 94 on which the circulation air discharge hole is formed may be mounted on the outer housing 11.

The control unit 100 may be coupled to the front of the main body 10, and an intake grill 120 may be coupled to an upper portion of the control unit 100

The intake grill 120 may be disposed in front of the discharge panel 92. More specifically, the intake grill 120 may be accommodated in the recessed portion of the door 20 to be disposed parallel to the door 20 on one side of the door 20. At the same time, the intake grill 120 may be disposed in a portion of the rear of the door 20.

Air outside the cooking apparatus 1 may be introduced into the main body 10 through the intake grill 120. The intake grill 120 may include a first cooling air inlet hole 121. Therefore, air may be introduced through the first cooling air inlet hole 121 formed on the intake grill 120 to cool the electrical equipment room 60.

The air introduced through the intake grill 120 may cool the electrical equipment room 60 and be introduced back into the cooking chamber 30 to cool a rear surface of the door 20, and then be discharged through a cooling air discharge hole 93 formed on the upper surface of the main body 10. More specifically, the cooling air discharge hole 93 may be formed by cutting a portion of the upper surface of the outer housing 11.

Figure 4:
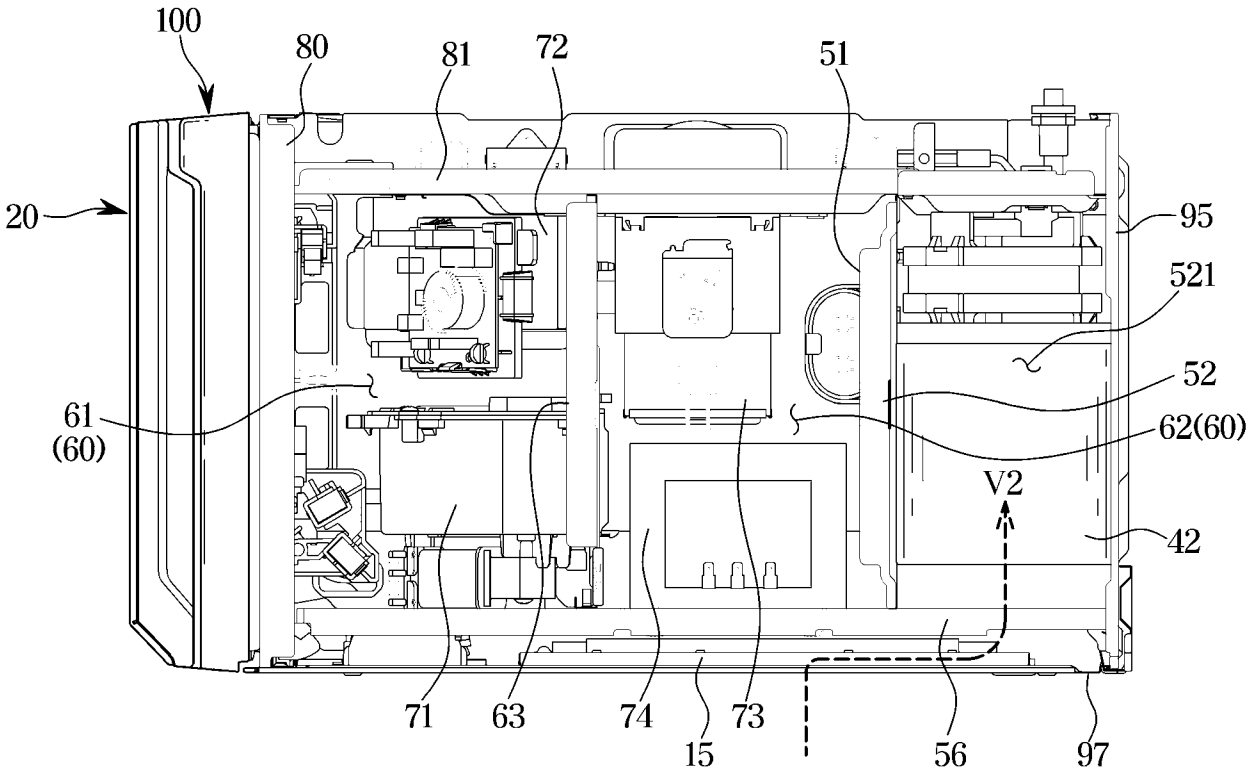
FIG. 4 is a side view illustrating one side of the cooking apparatus according to an embodiment of the present disclosure, from which an outer housing is removed.
Figure 5:
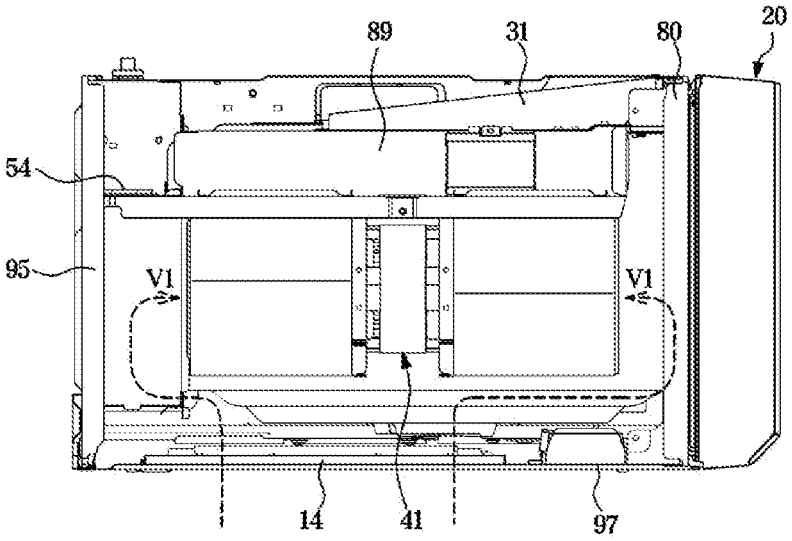
FIG. 5 is a side view illustrating the other side of the cooking apparatus according to an embodiment of the present disclosure, from which the outer housing is removed.

FIG. 4 is a side view illustrating one side of the cooking apparatus according to an embodiment of the present disclosure, from which an outer housing is removed. FIG. 5 is a side view illustrating the other side of the cooking apparatus according to an embodiment of the present disclosure, from which the outer housing is removed.

Referring to FIG. 4, the cooking apparatus 1 may include the electrical equipment room 60. More specifically, the electrical equipment room 60 may include a first electrical equipment room 61 and a second electrical equipment room 62.

The inner housing 12 of the main body 10 may include an upper plate 81 and a front plate 80.

The control unit 100 may be mounted on the front of the front plate 80. The first electrical equipment room 61 and the second electrical equipment room 62 may be provided at the rear of the front plate 80.

The electrical equipment room 60 may be provided to be partitioned inside the main body 10 by the front plate 80, the upper plate 81, a cooling divider 51, and a circulation plate 56. In addition, the electrical equipment room 60 may be divided into two parts by a partition plate 63 partitioning the first electrical equipment room 61 and the second electrical equipment room 62. The cooling divider 51 may be provided by one side of a rear bracket 52.

The circulation plate 56 may form a bottom surface of the electrical equipment room 60. The circulation plate 56 may be provided to be spaced apart from the bottom plate 97 of the outer housing 11.

The cooling divider 51 may be disposed above the circulation plate 56 to partition the electrical equipment room 60.

As the electrical equipment room 60 is partitioned by the circulation plate 56 and the cooling divider 51, the oil vapor introduced through the second circulation air intake part 15 formed on the lower surface of the main body 10 may not permeate into the electrical equipment room 60. Through this, components disposed inside the electrical equipment room 60 may be protected from the oil vapor or other foreign substances.

A cooling fan 71 may be accommodated inside the first electrical equipment room 61. The cooling fan 71 may flow air so that external air is introduced into the intake grill 120.

In addition, as will be described later, because the control unit 100 is mounted on the front plate 80 to communicate with the first electrical equipment room 61, the air introduced into the intake grill 120 may cool the control unit 100. A detailed description related to this will be given later.

A magnetron 73 and a transformer 74 may be accommodated in the second electrical equipment room 62. The magnetron 73 and the transformer 74 may be provided to generate high frequency waves. The generated high frequency waves may be supplied into the cooking chamber 30 to heat food to be cooked.

Hereinafter, the cooling flow path C of the cooking apparatus 1 will be described.

The partition plate 63 partitioning the first electrical equipment room 61 and the second electrical equipment room 62 may be provided to be partially opened. The partition plate 63 may include a lower opening (not shown) communicating with the cooling fan 71 so that the air drawn into the intake grill 120 by the cooling fan 71 passes through the first electrical equipment room 61 and is introduced into the second electrical equipment room 62. In addition, the partition plate 63 may include an upper opening (not shown) through which the second electrical equipment room 62 communicates with a guide duct 72.

The air introduced into the second electrical equipment room 62 may cool the transformer 74 and the magnetron 73 and then be introduced into the guide duct 72 mounted on the partition plate 63. The guide duct 72 may be disposed in the first electrical equipment room 61 to form a space through which the second electrical equipment room 62 communicates with the inside of the cooking chamber 30.

Therefore, the air introduced into the guide duct 72 may be introduced into the cooking chamber 30 to cool the rear surface of the door 20 during cooking. Thereafter, the air is introduced into an exhaust duct 31 communicating with an upper surface of the cooking chamber 30 and may be discharged to the outside of the cooking apparatus 1 through the cooling air discharge hole 93 communicating with the exhaust duct 31.

The cooking apparatus 1 may include, in addition to the cooling flow path C for cooling the electrical equipment room 60 and the door 20, circulation flow paths V1 and V2 for drawing and filtering out oil vapor.

The cooking apparatus 1 may include a second circulation fan 42 and the rear bracket 52. The rear bracket 52 may include a circulation fan accommodating portion 521 provided to accommodate the second circulation fan 42.

The front of the circulation plate 56 may be closed to partition the electrical equipment room 60. However, the circulation plate 56 may include a communication portion having an open rear to communicate with the circulation fan accommodating portion 521 of the rear bracket 52. As the communication portion is formed on the circulation plate 56, oil vapor may be introduced into the second circulation air intake part 15 by an intake force generated by the second circulation fan 42 and be filtered out.

Referring to FIG. 5, the cooking apparatus 1 may include a first circulation fan 41. The first circulation fan 41 may generate an intake force such that air is introduced into the first circulation air intake part 14 formed on the bottom plate 97. A side plate 89 of the inner housing 12 may be mounted above the first circulation fan 41. A portion of the side plate 89 may be cut out such that the introduced air flows upward of the first circulation fan 41.

Therefore, the cooking apparatus 1 according to an embodiment of the present disclosure may be provided to include the first circulation fan 41 and the second circulation fan 42 on opposite sides thereof. Through this, a plurality of the circulation flow paths V1 and V2 having the first circulation flow path V1 through which air flows by the first circulation fan 41 and the second circulation flow path V2 through which air flows by the second circulation fan 42 may be formed inside the cooking apparatus 1. A detailed description related to this will be given later.

Figure 6:
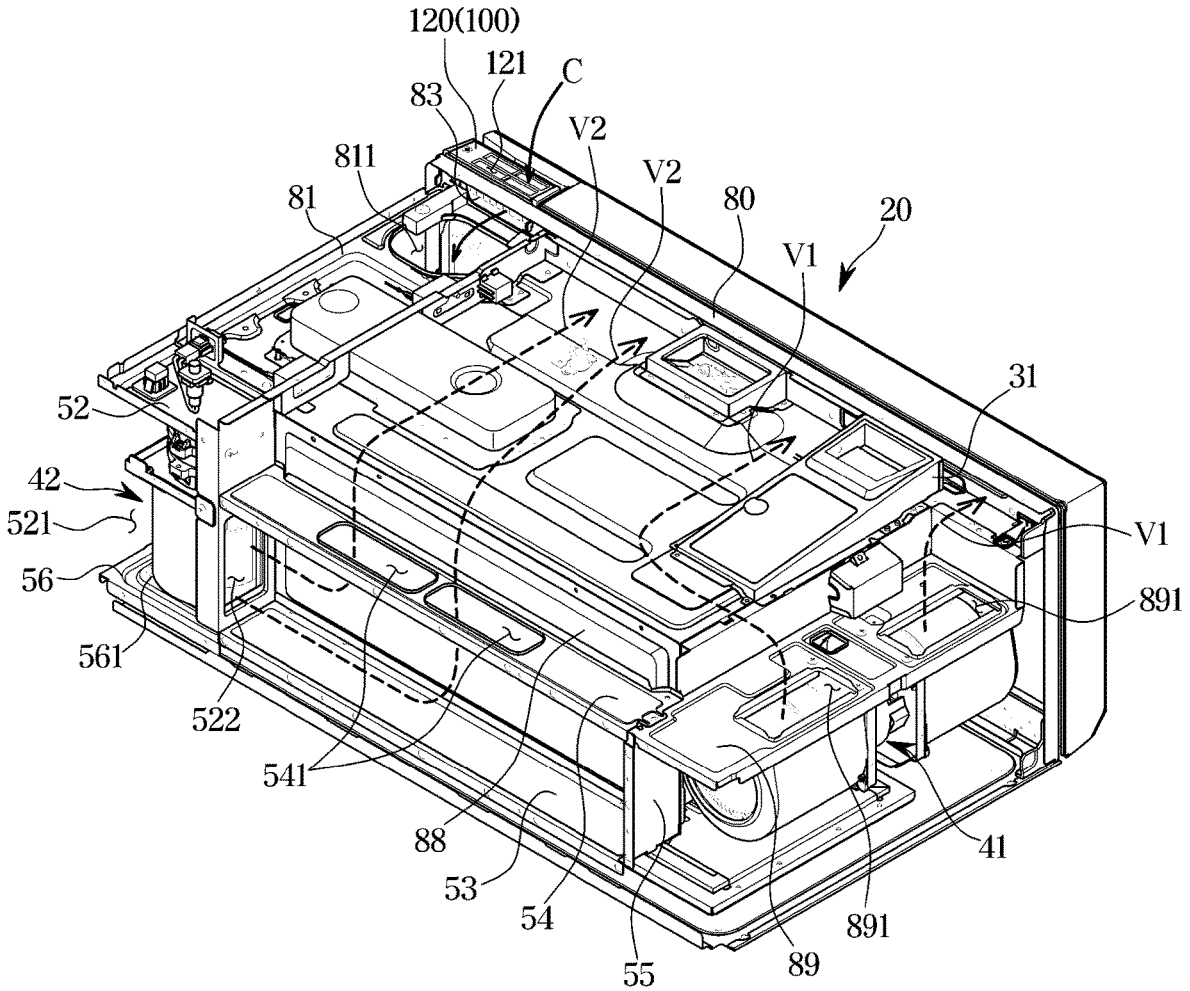
FIG. 6 is a rear perspective view illustrating a flow of air in the cooking apparatus according to an embodiment of the present disclosure in a state in which the outer housing is removed.
Figure 7:
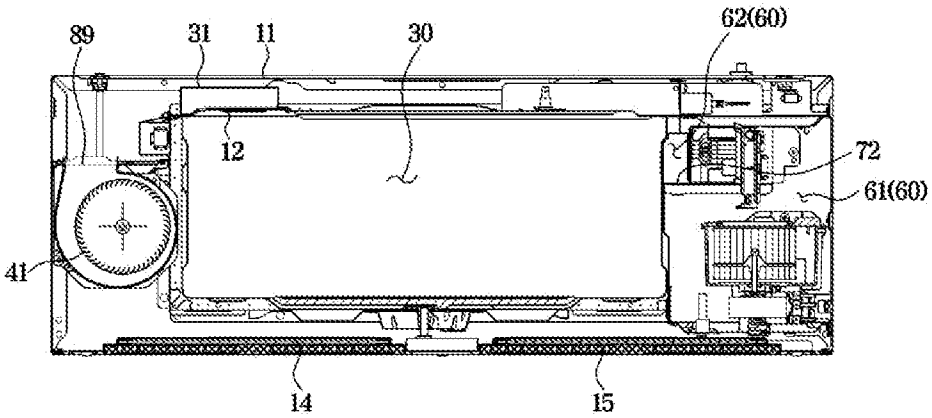
FIG. 7 is a cross-sectional view of the cooking apparatus according to an embodiment of the present disclosure.

FIG. 6 is a rear perspective view illustrating a flow of air in the cooking apparatus according to an embodiment of the present disclosure in a state in which the outer housing is removed. FIG. 7 is a cross-sectional view of the cooking apparatus according to an embodiment of the present disclosure.

Hereinafter, the first circulation flow path V1, the second circulation flow path V2, and the cooling flow path C according to an embodiment of the present disclosure will be described.

Referring to FIGS. 5 and 6, air may be introduced into the main body 10 through the first circulation air intake part 14 formed at a lower portion of the main body 10. The air at this time may be contaminated air containing oil vapor.

The introduced air may be filtered and pass through the first circulation fan 41. The air passed through the first circulation fan 41 may flow to the side plate 89 disposed above the first circulation fan 41.

The side plate 89 may include a first communication hole 891. The air passed through the first circulation fan 41 through the first communication hole 891 may flow to an upper portion of the inner housing 12.

As illustrated in FIG. 3, the flowed air may be discharged back to the outside of the cooking apparatus 1 through the first circulation air discharge hole 911 and the second circulation air discharge hole 921 formed on a front upper portion of the main body 10. This may be referred to as the first circulation flow path V1.

However, as described above, when the separate communication duct is provided to discharge the filtered oil vapor to the outside of the room, the air introduced into the first circulation air intake part 14 may be discharged to the outside of the cooking apparatus 1 through the circulation air discharge hole formed on the ventilation duct panel 94.

Referring to FIGS. 4 and 6, air may be introduced into the main body 10 through the second circulation air intake part 15 formed at the lower portion of the main body 10. The air at this time may also be contaminated air containing oil vapor.

The introduced air may be filtered and pass through the second circulation fan 42. More specifically, air may be introduced into the circulation fan accommodating portion 521 of the rear bracket 52 through a passing hole 561 formed on the circulation plate 56.

The rear bracket 52 may include a rear communication portion 522. The rear communication portion 522 may be formed at a portion partitioning a back plate 95 of the outer housing 11 and a rear plate 88 of the inner housing 12. Through this, the air introduced into the passing hole 561 may flow to the rear of the inner housing 12 through the rear communication portion 522.

The cooking apparatus 1 may include a bottom bracket 53, a partition bracket 54, and a circulation divider 55.

The bottom bracket 53 and the partition bracket 54 may be disposed between the outer housing 11 and the inner housing 12. More specifically, the bottom bracket 53 and the partition bracket 54 may be disposed at the rear of the inner housing 12 to extend horizontally. The bottom bracket 53 may be disposed below the partition bracket 54 to face the partition bracket 54.

The circulation divider 55 may be disposed between the outer housing 11 and the inner housing 12. More specifically, the circulation divider 55 may be disposed at the rear of the inner housing 12 to extend horizontally. That is, the circulation divider 55 may be disposed to face a communication portion 84 and the communication portion 522 of the rear bracket 52.

The partition bracket 54 may include a second communication hole 541. The second communication hole 541 may be formed by cutting a portion of the partition bracket 54. The second communication hole 541 may be provided to allow air to flow.

Therefore, the rear bracket 52, the bottom bracket 53, the partition bracket 54, and the circulation divider 55 may be provided to form a portion of a flow path through which the air introduced into the second circulation air intake part 15 flows.

The air introduced into the second circulation air intake part 15 may pass through the second circulation fan 42 via the passing hole 561 of the circulation plate 56, pass through the communication portions 84 and 522 of the rear bracket 52, and flow between the bottom bracket 53 and the partition bracket 54.

In this case, the circulation divider 55 may be closed without an open portion and disposed between the partition bracket 54 and the bottom bracket 53. Therefore, the air may flow to a rear upper portion of the inner housing 12 through the second communication hole 541 of the partition bracket 54.

The air flowed to the upper portion of the inner housing 12 through the second communication hole 541 may be discharged back to the outside of the cooking apparatus 1 through the first circulation air discharge hole 911 and the second circulation air discharge hole 921 formed on the front upper portion of the main body 10. This may be referred to as the second circulation flow path V2.

However, as described above, when the separate communication duct is provided to discharge the filtered oil vapor to the outside of the room, the air introduced into the second circulation air intake part 15 may be discharged to the outside of the cooking apparatus 1 through the circulation air discharge hole formed on the ventilation duct panel 94.

As the circulation divider 55 is provided to be closed, the air introduced by the first circulation fan 41 and the air introduced by the second circulation fan 42 may flow in a separated state at a lower portion of the inner housing 12 and be merged at the upper portion of the inner housing 12.

Referring to FIGS. 6 and 7, the air introduced into the intake grill 120 disposed at the upper portion of the control unit 100 may cool various electrical components while flowing through the first electrical equipment room 61 and the second electrical equipment room 62. More specifically, the air introduced into the first cooling air inlet hole 121 of the intake grill 120 may be introduced into the main body 10 through a second cooling air inlet hole 83 of the front plate 80. Thereafter, the air may be introduced into the electrical equipment room 60 through a cutout portion 811 formed on the upper plate 81 of the inner housing 12.

The air introduced into the first electrical equipment room 61 may be introduced into the second electrical equipment room 62 through the cooling fan 71, and the air introduced into the second electrical equipment room 62 may be guided into the cooking chamber 30 by the guide duct 72 communicating with a side surface of the cooking chamber 30. The air guided into the cooking chamber 30 may be introduced into the exhaust duct 31 communicating with the upper surface of the cooking chamber 30 after cooling the rear surface of the door 20. The exhaust duct 31 may be provided to communicate with the cooling air discharge hole 93. Therefore, the air that has completed cooling may be discharged to the outside of the cooking apparatus 1 through the cooling air discharge hole 93. This may be referred to as the cooling flow path C.

Figure 8:
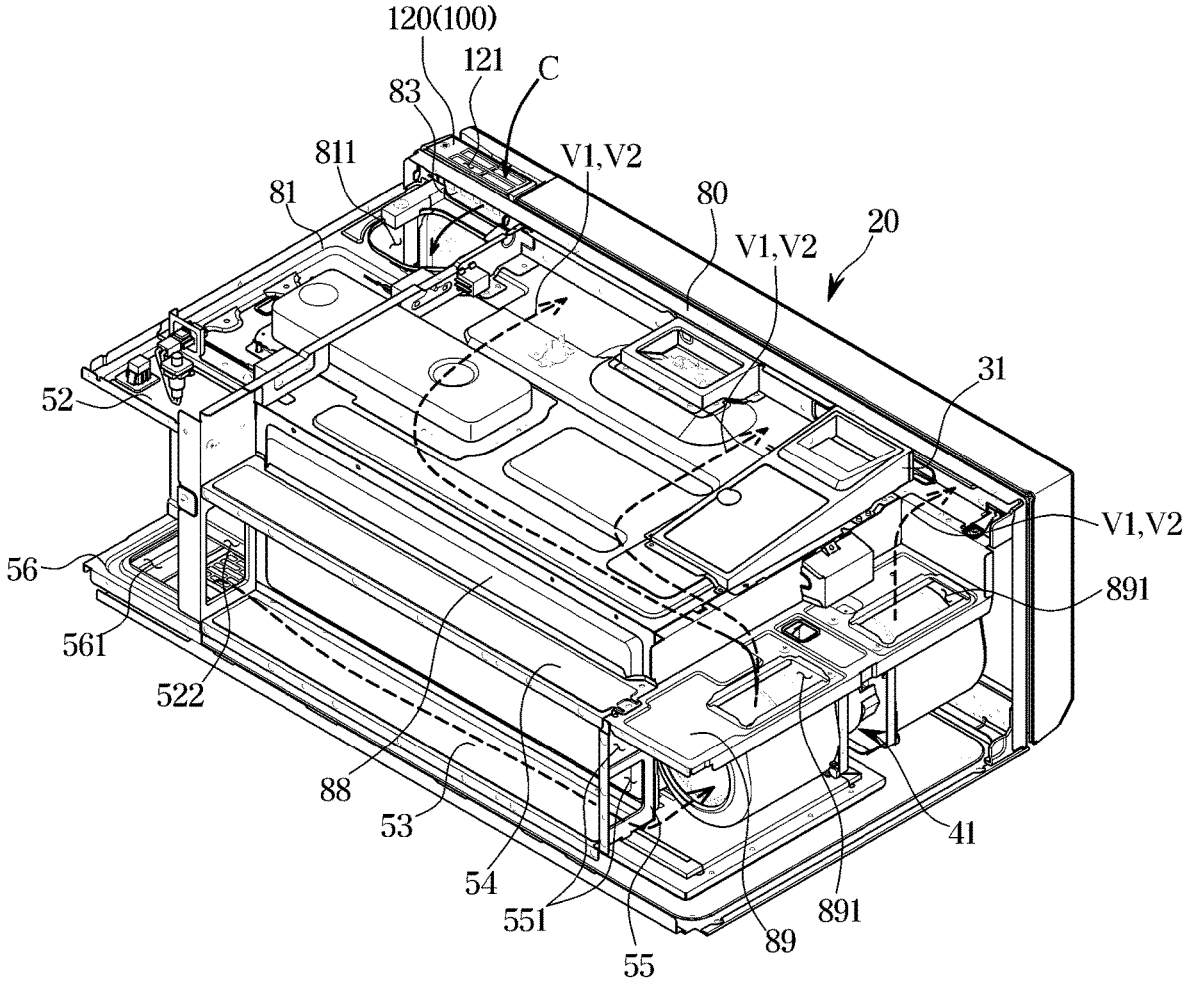
FIG. 8 is a rear perspective view illustrating a flow of air in a cooking apparatus according to another embodiment of the present disclosure in a state in which the outer housing is removed.

FIG. 8 is a rear perspective view illustrating a flow of air in a cooking apparatus according to another embodiment of the present disclosure in a state in which the outer housing is removed.

Unlike the cooking apparatus 1 according to an embodiment of the present disclosure, a cooking apparatus according to another embodiment of the present disclosure may include a single circulation fan. More specifically, only the first circulation fan 41 may be provided.

Accordingly, unlike the cooking apparatus according to an embodiment of the present disclosure, in the cooking apparatus according to another embodiment of the present disclosure, one circulation flow path may be formed.

On the other hand, the cooking apparatus according to another embodiment of the present disclosure includes the same configuration as the cooking apparatus 1 according to an embodiment of the present disclosure, except that the configuration of the circulation divider 55 and the partition bracket 54 are provided differently.

Therefore, description of the same configuration as the above-described cooking apparatus 1 will be omitted, and the same reference numerals may be assigned.

The cooking apparatus according to another embodiment of the present disclosure may include the first circulation fan 41 disposed between the inner housing 12 and the outer housing 11. Air may be drawn into the first circulation air intake port and the second circulation air intake port through the first circulation fan 41.

More specifically, the air introduced into the first circulation air intake port may pass through the first circulation fan 41 and pass through the first communication hole 891 of the side plate 89. The air passed through the first communication hole 891 may be discharged to the outside of the cooking apparatus through the first circulation air discharge hole 911 of the service panel 91 and the second circulation air discharge hole 921 of the discharge panel 92.

However, as described above, when the separate communication duct (not shown) is provided to discharge the filtered oil vapor to the outside of the room, the air introduced into the first circulation air intake part may be discharged to the outside of the cooking apparatus through the circulation air discharge hole formed on the ventilation duct panel 94.

This may be provided to be the same as the first circulation flow path V1 of the cooking apparatus 1 according to an embodiment of the present disclosure.

However, the air introduced into the second circulation air intake port may pass through the passing hole 561 of the circulation plate 56 and be introduced into a space between the partition bracket 54 and the bottom bracket 53 through the rear communication portion 522 of the rear bracket 52.

In this case, the partition bracket 54 may be provided to be closed without an open portion. Specifically, unlike the cooking apparatus according to an embodiment of the present disclosure, the second communication hole may not be formed on the partition bracket 54.

However, the partition bracket 54 may be closed and a second communication hole 551 may be formed on the circulation divider 55. Therefore, the air introduced into the second circulation air intake port may be introduced into the space between the partition bracket 54 and the bottom bracket 53 and flow toward the first circulation fan 41 through the second communication hole 551 of the circulation divider 55.

Thereafter, the air passed through the first circulation fan 41 may flow to the upper portion of the inner housing 12 through the first communication hole 891 of the side plate 89. The flowed air may be discharged to the outside of the cooking apparatus through the first circulation air discharge hole 911 of the service panel 91 and the second circulation air discharge hole 921 of the discharge panel 92.

However, as described above, when the separate communication duct (not shown) is provided to discharge the filtered oil vapor to the outside of the room, the air introduced into the second circulation air intake part may be discharged to the outside of the cooking apparatus through the circulation air discharge hole formed on the ventilation duct panel 94.

Therefore, in the cooking apparatus according to another embodiment of the present disclosure, by closing the partition bracket 54 and opening the circulation divider 55, air may be drawn into the first circulation air intake port and the second circulation air intake port using only the intake force of the first circulation fan 41.

Therefore, as the cooking apparatus is manufactured with a simpler structure, manufacturing costs may be reduced. In addition, because only the configuration of the partition bracket 54 and the circulation divider 55 may be replaced depending on needs of the user, there is no need to complicatedly change an internal design depending on the number of circulation fans.

Figure 9:
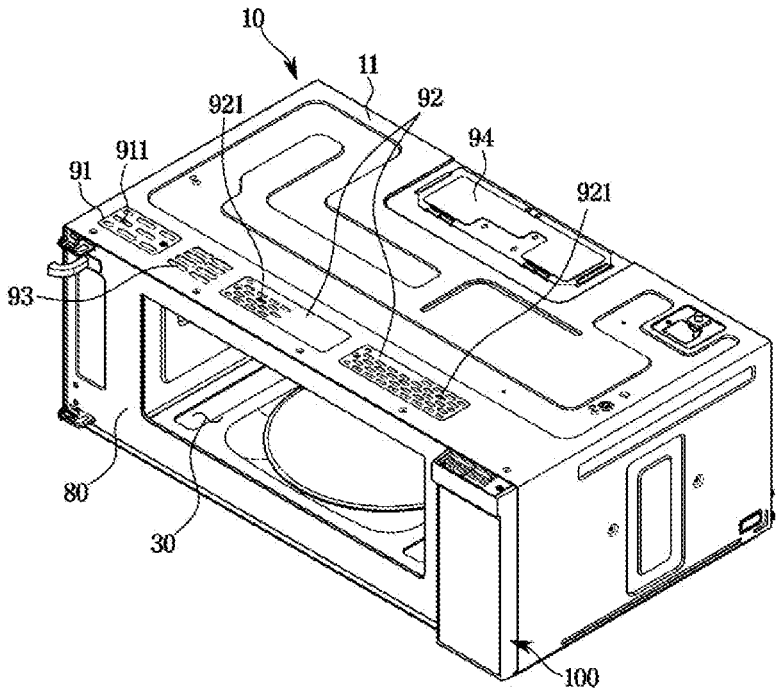
FIG. 9 is a view illustrating a state in which a control unit is coupled to a main body of the cooking apparatus according to an embodiment of the present disclosure.
Figure 10:
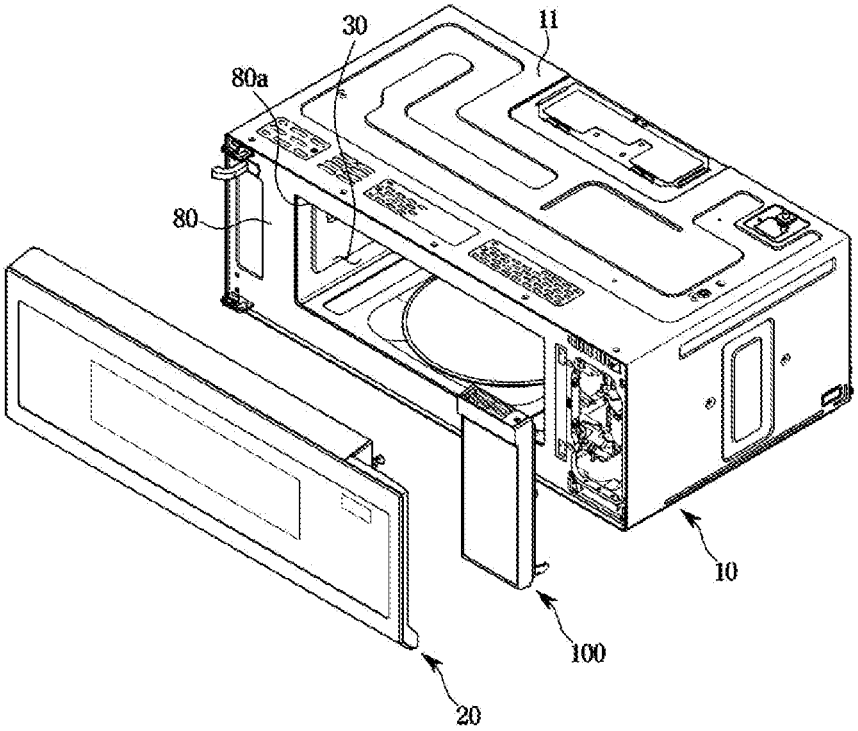
FIG. 10 is an exploded perspective view of a door, the control unit, and the main body of the cooking apparatus according to an embodiment of the present disclosure.

FIG. 9 is a view illustrating a state in which a control unit is coupled to a main body of the cooking apparatus according to an embodiment of the present disclosure. FIG. 10 is an exploded perspective view of a door, the control unit, and the main body of the cooking apparatus according to an embodiment of the present disclosure.

Referring to FIGS. 9 and 10, the control unit 100 may be mounted on the front of the main body 10.

More specifically, the main body 10 may include the front plate 80. The front plate 80 may include an opening **80*a*** communicating with the cooking chamber 30 and a mounting part 85 provided on one side of the opening 80*a* to which the control unit 100 is mounted.

The front plate 80 may also include a door fixing part 82 provided between the opening 80*a* and the mounting part 85. In detail, the door fixing part 82 may be provided such that a door latch (not shown) is inserted to maintain a state in which the door 20 closes the cooking chamber 30.

The opening 80*a* of the front plate 80 may be provided to communicate with the cooking chamber 30. The front plate 80 may include the communication portion 84 through which the electrical equipment room 60 and the control unit 100 communicate. The communication portion 84 may be provided on one side of the opening 80*a*. The communication portion 84 may also be formed on the same side as the mounting part 85. The mounting part 85 is formed around the communication portion 84 and may include a plurality of holes through which the control unit 100 is coupled.

One side of the door 20 may be recessed inward from the rear thereof to accommodate the control unit 100. Specifically, the door 20 may be rotatably coupled to the main body 10 to cover the front of the control unit 100. The user may open and close the door 20 through a handle formed between the control unit 100 and the door 20.

Figure 11:
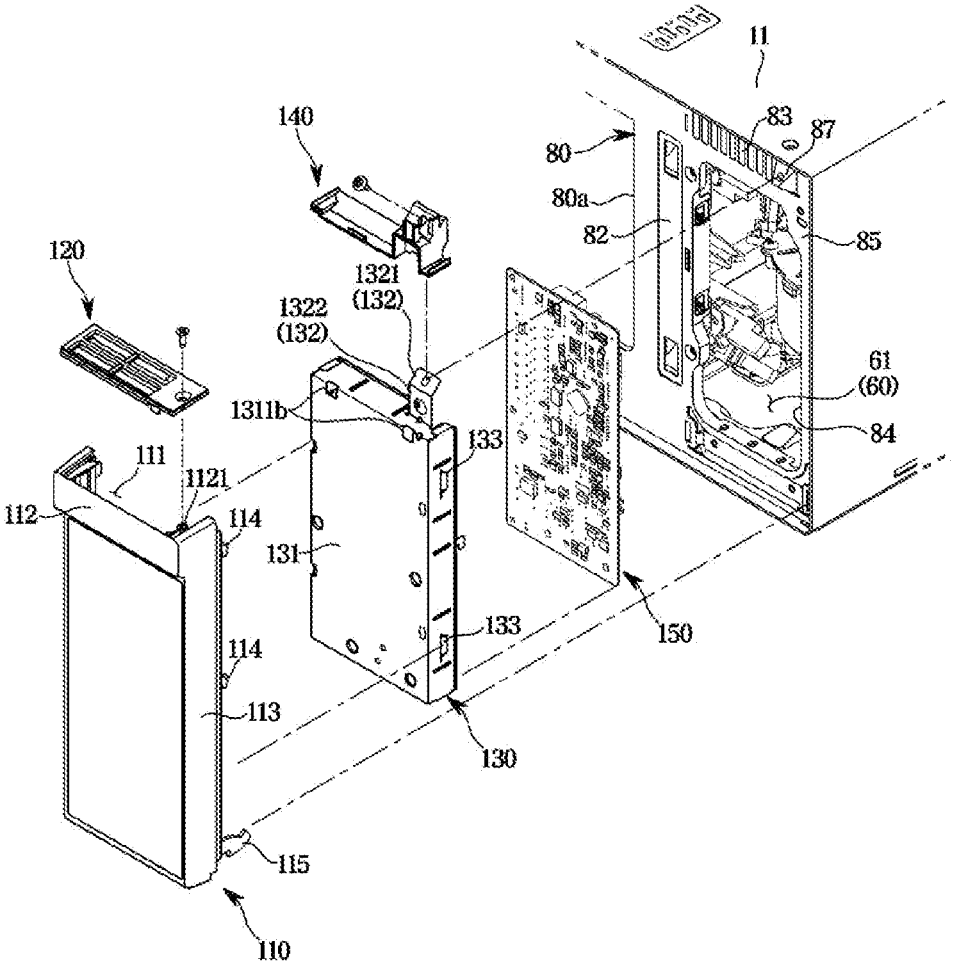
FIG. 11 is an enlarged front exploded perspective view of the control unit and the main body shown in FIG. 10.
Figure 12:
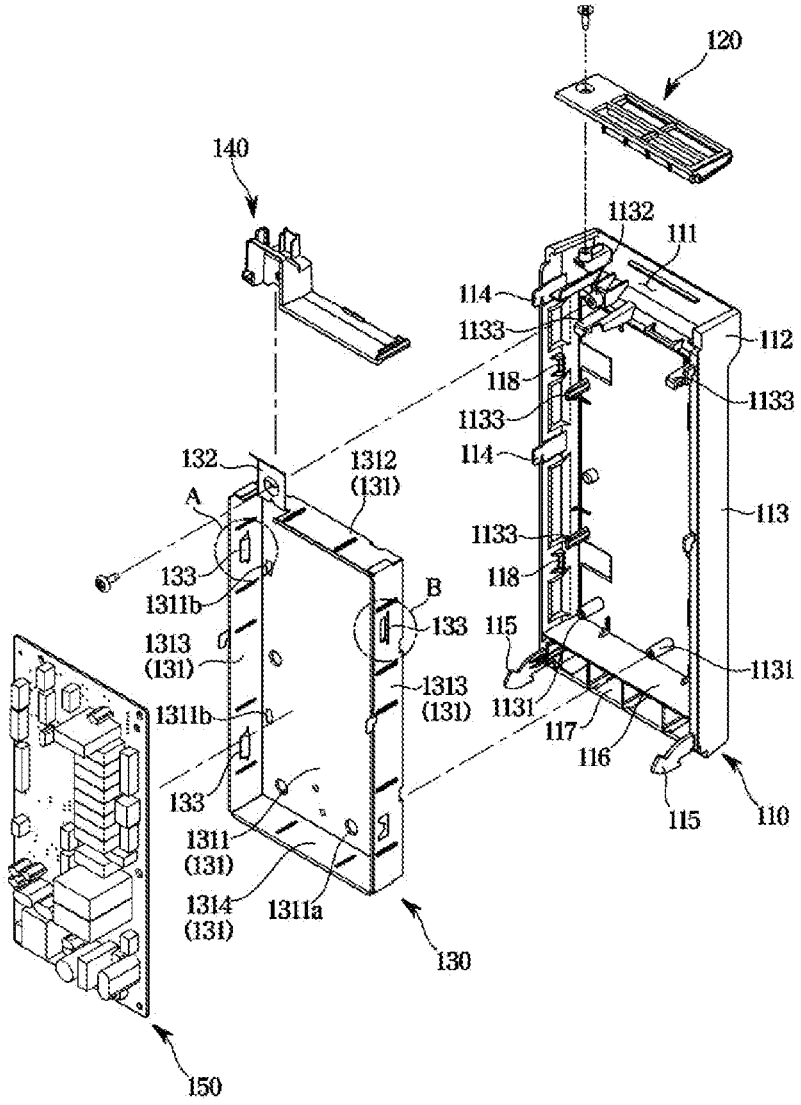
FIG. 12 is an enlarged rear exploded perspective view of the control unit shown in FIG. 10.
Figure 13:
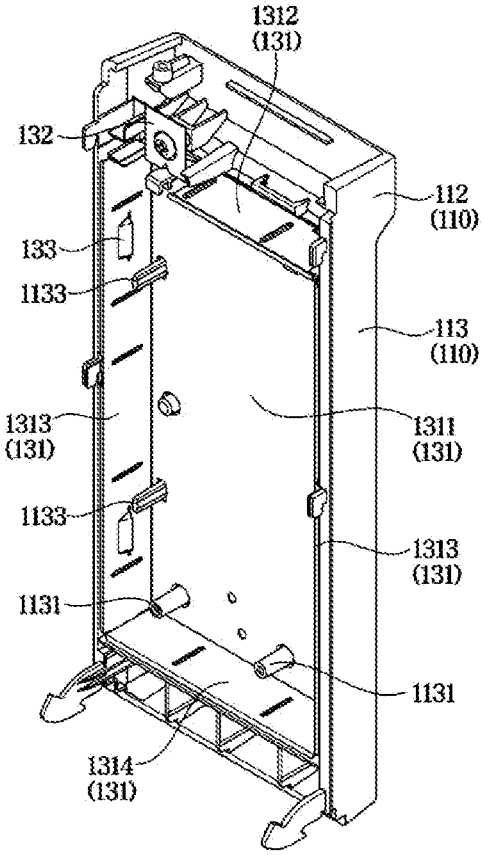
FIG. 13 is a rear perspective view illustrating a state in which a case, a bracket panel, and a guide member shown in FIG. 12 are coupled.

FIG. 11 is an enlarged front exploded perspective view of the control unit and the main body shown in FIG. 10. FIG. 12 is an enlarged rear exploded perspective view of the control unit shown in FIG. 10. FIG. 13 is a rear perspective view illustrating a state in which a case, a bracket panel, and a guide member shown in FIG. 12 are coupled.

Referring to FIGS. 11 to 13, the control unit 100 may include a case 110 and the intake grill 120 mounted on an upper side of the case 110. The control unit 100 may be provided in front of the main body 10.

The case 110 and the intake grill 120 may be provided to form an exterior of the control unit 100. More specifically, the case 110 has an opening 111 formed on an upper surface thereof, and the intake grill 120 may be coupled to the upper side of the case 110 to cover the opening 111 of the case 110.

The intake grill 120 may include the first cooling air inlet hole 121 formed on the upper surface. The intake grill 120 may be screwed with a grill coupling boss 1121 formed inside the case 110.

The case 110 may be provided in a box shape with an open rear portion. Specifically, the case 110 may have the open rear portion to communicate with the inside of the main body 10 and be mounted on the front of the main body 10.

The case 110 may include a body part 113 and a flow path forming part 112.

More specifically, the body part 113 may be provided to accommodate a bracket panel 130. The body part 113 may be provided to cover front, side and lower sides of the bracket panel 130.

The flow path forming part 112 may extend upward of the body part 113. The flow path forming part 112 may also extend forward of the body part 113. The opening 111 may be formed above the flow path forming part 112.

Therefore, as the intake grill 120 is coupled to the flow path forming part 112, the air introduced into the first cooling air inlet hole 121 of the intake grill 120 may pass through the flow path forming part 112 of the case 110 and be introduced into the second cooling air inlet hole 83 of the front plate 80.

The case 110 may include an insertion leg 115 and a fixing leg 114 extending rearward of the body part 113 to be inserted into the plurality of insertion holes of the mounting part 85 of the front plate 80.

The insertion leg 115 may be provided to extend toward the front plate 80 from the rear of the case 110. The insertion leg 115 may extend rearward from a rear surface of the body part 113. The insertion leg 115 is provided in a substantially hook shape so that the case 110 may be fixed to the front plate 80. The insertion leg 115 may be formed on a lower side of the case 110.

The fixing leg 114 may be formed above the insertion leg 115. The fixing leg 114 may be provided to extend toward the front plate 80 from the rear of the case 110. The fixing leg 114 may extend rearward from the rear surface of the body part 113.

The case 110 may include the grill coupling boss 1121. The grill coupling boss 1121 may be provided on the flow path forming part 112 to be screwed with the intake grill 120.

The case 110 may include a board coupling boss 1131 and a panel coupling boss 1132.

The board coupling boss 1131 and the panel coupling boss 1132 may extend from a front inner surface of the case 110 toward the rear of the case 110.

The board coupling boss 1131 may extend to the rear of the case 110 to penetrate the bracket panel 130. Specifically, the board coupling boss 1131 may be provided to pass through a boss through hole 1311*a* of the bracket panel 130 such that a circuit board 150 is screwed to the case 110.

The panel coupling boss 1132 may extend to the rear of the case 110 to penetrate the bracket panel 130. More specifically, the panel coupling boss 1132 may be provided to pass through a coupling flange 132 of the bracket panel 130. That is, the panel coupling boss 1132 may be provided such that the bracket panel 130 is screwed to the case 110.

The case 110 may include a panel fixing protrusion 1133.

The panel fixing protrusion 1133 may extend rearward from the front inner surface of the case 110. The panel fixing protrusion 1133 may be provided to pass through a protrusion passing hole 1311*b* of the bracket panel 130. As the panel fixing protrusion 1133 is inserted into the protrusion passing hole 1311*b* of the bracket panel 130, a position of the bracket panel 130 may be fixed inside the case 110. In addition, the panel fixing protrusion 1133 may be provided to guide an accurate position where the bracket panel 130 is screwed to the case 110.

The case 110 may include a case partition plate 116 and a case bottom plate 117.

The case partition plate 116 may be provided to extend rearward from the front inner surface of the case 110. The case partition plate 116 may be provided in a substantially rectangular flat plate shape. The case partition plate 116 may be provided at the same height as a lower portion of the communication portion 84 of the front plate 80. The case partition plate 116 may be provided such that a lower wall 1314 of the bracket panel 130, which will be described later, is seated thereon.

The case bottom plate 117 may be formed below the case partition plate 116. The case bottom plate 117 may be provided to extend rearward from the front inner surface of the case 110. The case bottom plate 117 may be provided to form a lower surface of the control unit 100.

The case 110 may include a protrusion 118.

The protrusion 118 may be provided to extend from an inner surface of the case 110 toward the bracket panel 130. More specifically, the protrusion 118 may be provided to protrude inward from a side surface of the case 110. The protrusion 118 may be provided to be inserted into a fixing rib 133 of the bracket panel 130, which will be described later.

The case 110 may be made of a resin material. Therefore, the case 110 may be provided to have a predetermined elastic force. The protrusion 118 of the case 110 may be inserted into the fixing rib 133 of the bracket panel 130 elastically. Through this, the bracket panel 130 may be prevented from moving inside the case 110.

The control unit 100 may include the circuit board 150 and the bracket panel 130 on which the circuit board 150 is mounted.

The bracket panel 130 may be provided to be accommodated inside the case 110. The bracket panel 130 may be provided in a substantially box shape with an open rear surface. The circuit board 150 may be accommodated inside the bracket panel 130. The circuit board 150 may be fixed inside the bracket panel 130.

Through the bracket panel 130, the circuit board 150 may be blocked from external impacts or foreign substances.

The circuit board 150 may be provided to be accommodated at the rear of the bracket panel 130 so as to be disposed on the communication portion 84 of the front plate 80. In other words, the circuit board 150 may be provided to communicate with the first electrical equipment room 61. Through this, air for cooling is introduced into the intake grill 120 to cool the circuit board 150 while cooling the components of the first electrical equipment room 61.

The bracket panel 130 may include a board accommodating frame 131 and the coupling flange 132.

The board accommodating frame 131 may have a size corresponding to that of the circuit board 150. The circuit board 150 may be accommodated inside the board accommodating frame 131. The board accommodating frame 131 may be provided in a substantially box shape with an open rear. The board accommodating frame 131 may be provided in a shape corresponding to the opposite side surfaces and a lower surface of the case 110 and accommodated inside the case 110.

More specifically, the board accommodating frame 131 may include a frame body 1311 provided in parallel to the rear surface of the case 110. The frame body 1311 may form the front surface of the board accommodating frame 131.

The board accommodating frame 131 may include an upper wall 1312, opposite side walls 1313, and a lower wall 1314 that are bent rearward from the frame body 1311.

The frame body 1311, the upper wall 1312, the opposite side walls 1313, and the lower wall 1314 of the board accommodating frame 131 may be integrally formed. The upper wall 1312 may form an upper surface of the bracket panel 130. The opposite side walls 1313 may form opposite side surfaces of the bracket panel 130. The lower wall 1314 may form a lower surface of the bracket panel 130.

The frame body 1311 may include the boss passing hole 1311*a* and the protrusion passing hole 1311*b*. The board coupling boss 1131 of the case 110 may pass through the boss passing hole 1311*a* of the frame body 1311. In addition, the panel fixing protrusion 1133 of the case 110 may pass through the protrusion passing hole 1311*b* of the frame body 1311.

The coupling flange 132 may extend upward from the upper wall 1312 of the bracket panel 130. More specifically, the coupling flange 132 may be provided to be coupled with the guide member and the case 110.

The coupling flange 132 may include a first flange 1321 and a second flange 1322.

The first flange 1321 and the second flange 1322 of the coupling flange 132 may be provided to be bent to each other. The first flange 1321 of the coupling flange 132 may be provided at an angle corresponding to a guide coupling part 87 of the front plate 80. The guide member, the bracket panel 130, and the front plate 80 may be screwed together through the first flange 1321 of the coupling flange 132.

The second flange 1322 may be provided below the first flange 1321. The case 110, the guide member, and the bracket panel 130 may be screwed together through the second flange 1322 of the coupling flange 132. More specifically, the panel coupling boss 1132 of the case 110 may be provided to pass through the second flange 1322.

The bracket panel 130 may include the fixing rib 133 and a cutout hole 134.

The fixing rib 133 may be provided such that the protrusion 118 of the case 110 is inserted therein. Specifically, the fixing rib 133 may be formed on one surface of the bracket panel 130. The fixing rib 133 may be provided to extend inward from the side wall 1313 forming a side surface of the bracket panel 130. The fixing rib 133 may extend from an inner surface of the bracket panel 130 to cover the rear of the protrusion 118. That is, the fixing rib 133 may extend from the inner surface of the bracket panel 130 toward the front of the bracket panel 130.

The fixing rib 133 may be pressed inward from the side wall 1313 of the bracket panel 130 through lancing processing. Therefore, the cutout hole 134 through which the case 110 and the bracket panel 130 communicate may be formed at an end of the fixing rib 133.

A detailed description related to the fixing rib 133 and the cutout hole 134 will be given later.

The bracket panel 130 may be made of a steel material. Therefore, when a fire occurs inside the main body 10, the bracket panel 130 may be provided not to burn. The material of the bracket panel 130 is not limited to the above-described steel material, and may include any material made of a non-combustible material.

The control unit 100 may include a guide member 140 mounted on an upper side of the bracket panel 130.

The guide member 140 may be mounted on the upper side of the bracket panel 130. More specifically, the guide member 140 may be seated on an upper portion of the upper wall 1312 of the bracket panel 130. In addition, the guide member 140 may be provided to be screwed with the coupling flange 132 of the bracket panel 130.

The guide member 140 may be provided to prevent moisture or foreign substances introduced from the first cooling air inlet hole 121 of the intake grill 120 from permeating the circuit board 150.

Figure 14:
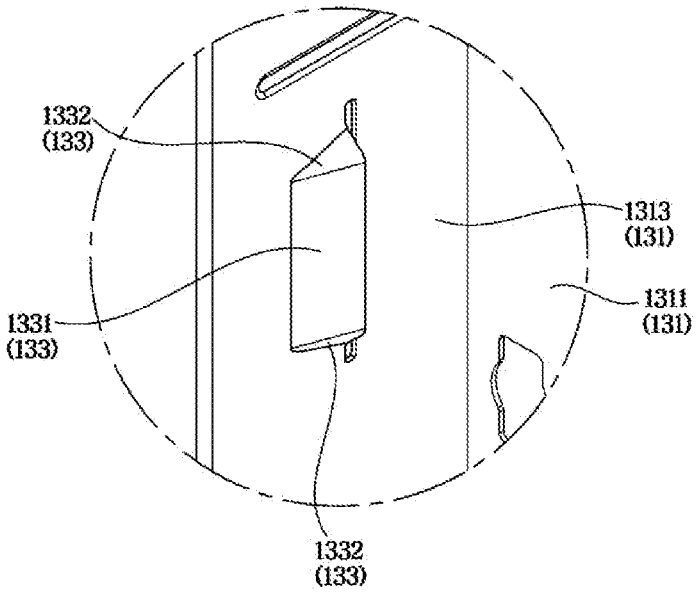
FIG. 14 is an enlarged view of part A of FIG. 12.
Figure 15:
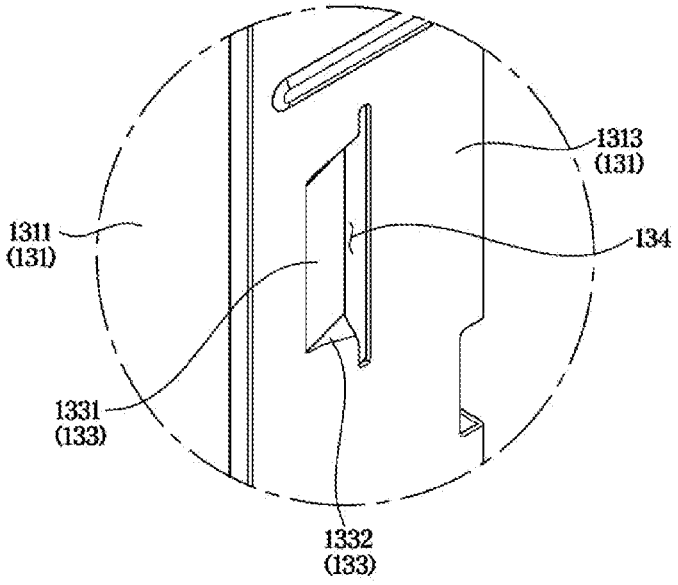
FIG. 15 is an enlarged view of part B of FIG. 12.

FIG. 14 is an enlarged view of part A of FIG. 12. FIG. 15 is an enlarged view of part B of FIG. 12.

Referring to FIGS. 14 and 15, the fixing rib 133 of the bracket panel 130 may include a blocking portion 1331 provided to face the inside of the main body 10 so as to cover the protrusion 118 from the rear.

The fixing rib 133 of the bracket panel 130 may also include a connecting portion 1332 connected to both ends of the blocking portion 1331 and connected to the inner surface of the bracket panel 130. Specifically, the connecting portion 1332 may be connected to the side wall 1313 of the bracket panel 130.

The bracket panel 130 may also include the cutout hole 134 formed at a front end of the blocking portion 1331 to communicate with the case 110. Specifically, the cutout hole 134 may be formed at front ends of the blocking portion 1331 and the connecting portion 1332. The cutout hole 134 may be formed to face the frame body 1311 forming a front exterior of the bracket panel 130.

The blocking portion 1331 of the fixing rib 133 may extend to be inclined from an inner side of the side wall 1313 of the bracket panel 130 toward the front of the bracket panel 130.

Therefore, when the bracket panel 130 is viewed from the rear, the cutout hole 134 may not be visible. The fixing rib 133 is pressed inward from the side wall 1313 of the bracket panel 130 through lancing processing, but may be lanced such that the cutout hole 134 faces the front of the bracket panel 130.

Figure 16:
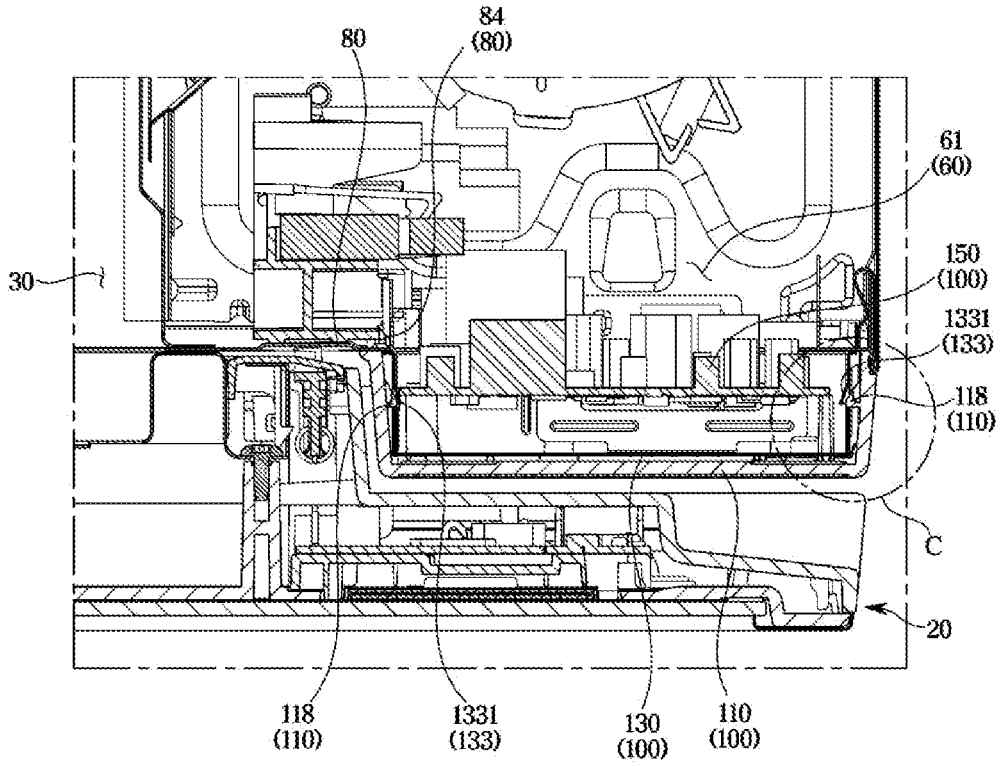
FIG. 16 is a cross-sectional view illustrating a state in which the control unit of the cooking apparatus according to an embodiment of the present disclosure is mounted on the main body.
Figure 17:
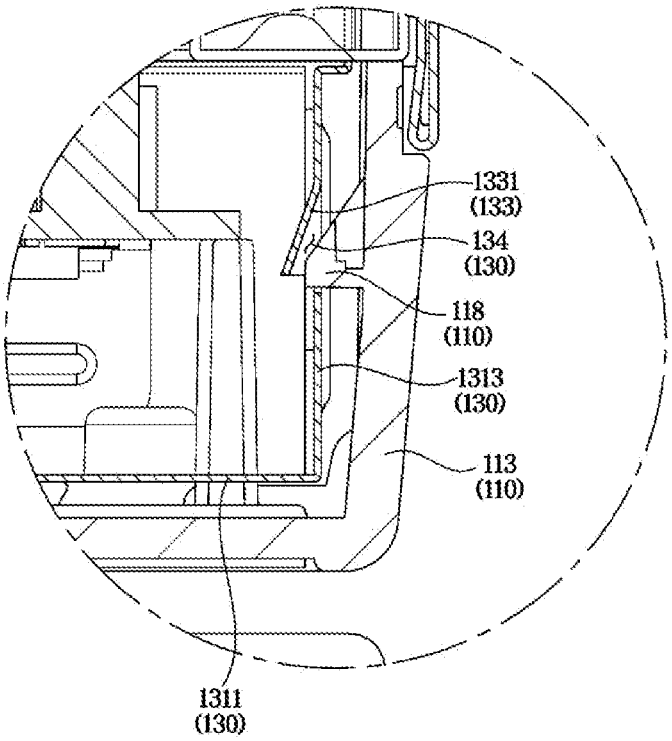
FIG. 17 is an enlarged view of part C of FIG. 16.

FIG. 16 is a cross-sectional view illustrating a state in which the control unit of the cooking apparatus according to an embodiment of the present disclosure is mounted on the main body. FIG. 17 is an enlarged view of part C of FIG. 16.

Referring to FIGS. 16 and 17, the control unit 100 may be mounted on the front of the front plate 80. Specifically, the control unit 100 may be mounted on the front of the front plate 80 to cover the communication portion 84 of the front plate 80.

The case 110 may be provided to form a front exterior of the control unit 100. The bracket panel 130 may be disposed at the rear of the case 110. The circuit board 150 may be mounted at the rear of the bracket panel 130 to communicate with the first electrical equipment room 61 through the communication portion 84.

In addition, the cooking chamber 30 may be provided on a side of the first electrical equipment room 61. The first electrical equipment room 61 may be provided to communicate with the cooking chamber 30 through the second electrical equipment room 62. Therefore, a fire occurred inside the cooking chamber 30 may be transferred to the electrical equipment room 60.

As illustrated in FIG. 17, the fixing rib 133 may extend inward from the side wall 1313 of the bracket panel 130. Specifically, the fixing rib 133 may be provided to extend from the inner surface of the bracket panel 130 toward the front. The cutout hole 134 may be formed at an end of the fixing rib 133.

The blocking portion 1331 of the fixing rib 133 may be disposed to face the electrical equipment room. More specifically, the blocking portion 1331 of the fixing rib 133 may be formed to be inclined toward the front of an inner side from the side wall 1313 of the bracket panel 130.

In addition, the protrusion 118 of the case 110 may be accommodated in front of the fixing rib 133. More specifically, the protrusion 118 of the case 110 may be inserted into the inner side of the side wall 1313 of the fixing rib 133. Through this, as the bracket panel 130 is fixed to the inside of the case 110, a movement of the bracket panel 130 may be prevented.

The bracket panel 130 is a member to which the circuit board 150 is mounted, and thus when the movement of the bracket panel 130 is transferred to the circuit board 150, an electrical problem may occur in the cooking apparatus 1. Therefore, the movement of the bracket panel 130 may be prevented through the configuration of the protrusion 118 and the fixing rib 133.

In addition, the blocking portion 1331 may be provided to block a flame when a fire occurs inside the electrical equipment room 60 or in the circuit board 150. In addition, as the cutout hole 134 is formed at the end of the blocking portion 1331, the cutout hole 134 is covered by the blocking portion 1331 so that the flame may not be transferred to the case 110 through the cut hole 134.

As the bracket panel 130 of the cooking apparatus 1 according to an embodiment of the present disclosure includes a steel material and the case 110 is made of a resin material, the case 110 may be provided to burn well.

Therefore, when a fire is transferred to the case 110 through the communication portion between the bracket panel 130 and the case 110, the fire may spread to the outside of the cooking apparatus 1 and cause a major safety accident.

Accordingly, as the blocking portion 1331 of the bracket panel 130 extends to be inclined toward the circuit board 150, spurting of the flame to the cutout hole 134 may be prevented.

Figure 18:
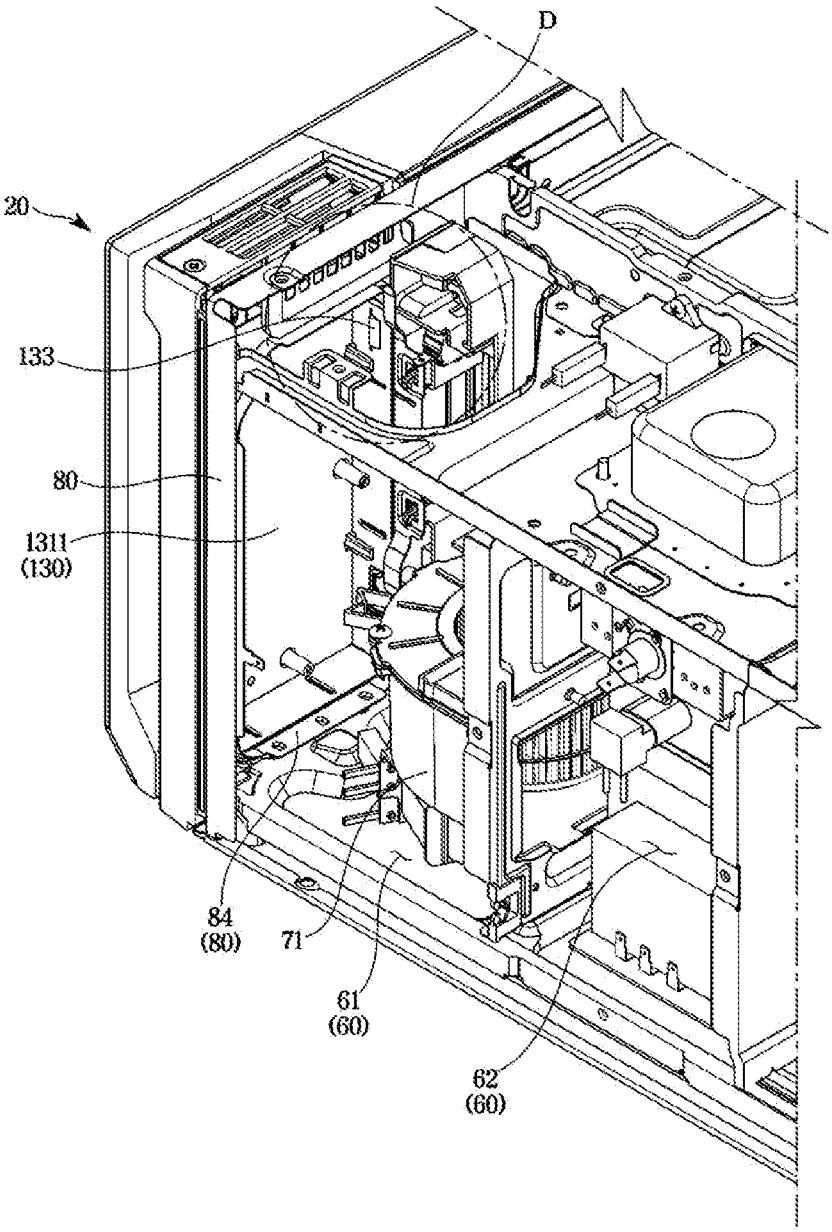
FIG. 18 is a rear view illustrating a state in which the bracket panel of the cooking apparatus according to an embodiment of the present disclosure is mounted on the front of the main body.
Figure 19:
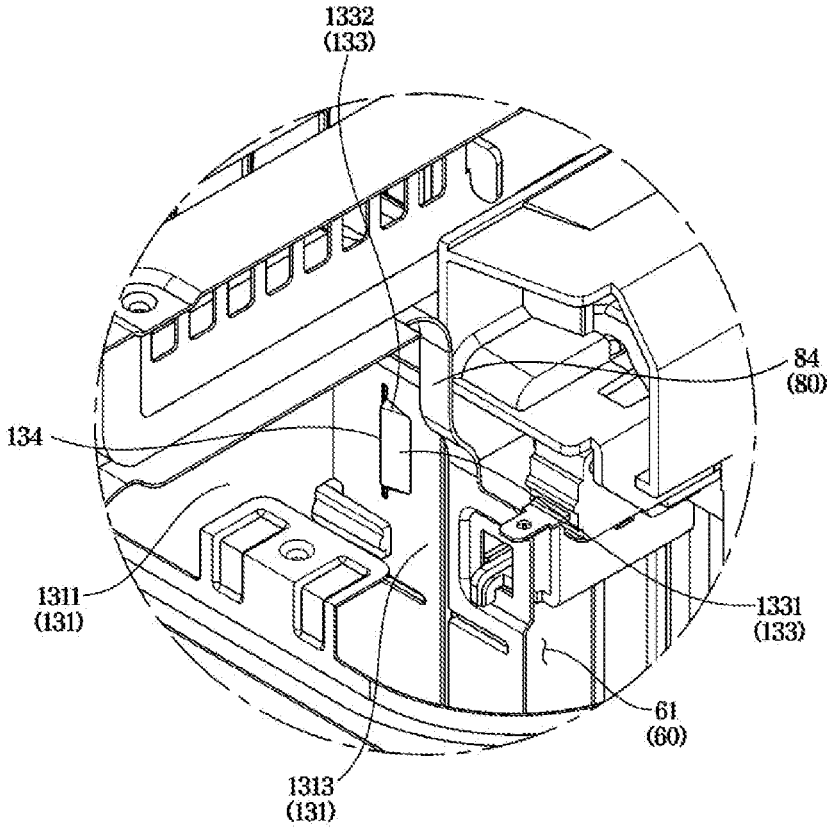
FIG. 19 is an enlarged view of part D of FIG. 18.

FIG. 18 is a rear view illustrating a state in which the bracket panel of the cooking apparatus according to an embodiment of the present disclosure is mounted on the front of the main body. FIG. 19 is an enlarged view of part D of FIG. 18.

As illustrated in FIGS. 18 and 19, the bracket panel and the case 110 may be disposed in front of the communication portion 84 of the front plate 80. Specifically, the bracket panel 130 and the case 110 may be coupled to the front of the front plate 80 to cover the communication portion 84.

The bracket panel 130 may be provided with an area substantially similar to a cutout area of the communication portion 84. However, the present disclosure is not limited thereto, and the bracket panel 130 may be provided to have a larger area than the cutout area of the communication portion 84.

FIGS. 18 and 19 illustrate that the circuit board 150 mounted on the rear of the bracket panel 130 is omitted. The circuit board 150 may be mounted on the rear of the bracket panel 130 to pass through the communication portion 84. Through this, the circuit board 150 may be disposed to face the first electrical equipment room 61.

The first electrical equipment room 61 in which the cooling fan 71 is disposed may be provided at the rear of the communication portion 84 to form a cooling flow path.

Therefore, the bracket panel 130 may cover the front of the communication portion 84, and at the same time may be disposed between the first electrical equipment room 61 and the case 110. That is, the bracket panel 130 may be provided to partition the case 110 and an electrical equipment room.

Through this, a flame occurring in the electrical equipment room or the cooking chamber 30 may not be transferred to the case 110 by being blocked by the bracket panel 130. Specifically, as the fixing rib 133 formed on the bracket panel 130 includes the blocking portion 1331, the flame may be prevented from directly spurting into the case 110 through the cutout hole 134.

In the case of the above-described bracket panel 130 according to an embodiment of the present disclosure, it has been described that the fixing rib 133 is formed on the side wall 1313 of the bracket panel 130, but a position of the fixing rib 133 may not be limited thereto.

More specifically, the fixing rib 133 may be formed on the lower wall 1314 of the bracket panel 130. In this case, the fixing rib 133 may be provided to extend forward from the lower wall 1314 of the bracket panel 130.

The fixing rib 133 may be provided to extend upward from the lower wall 1314 of the bracket panel 130. Even in this case, the cutout hole 134 may be formed to face the frame body 1311 of the bracket panel 130 without facing the rear.

Figure 20:
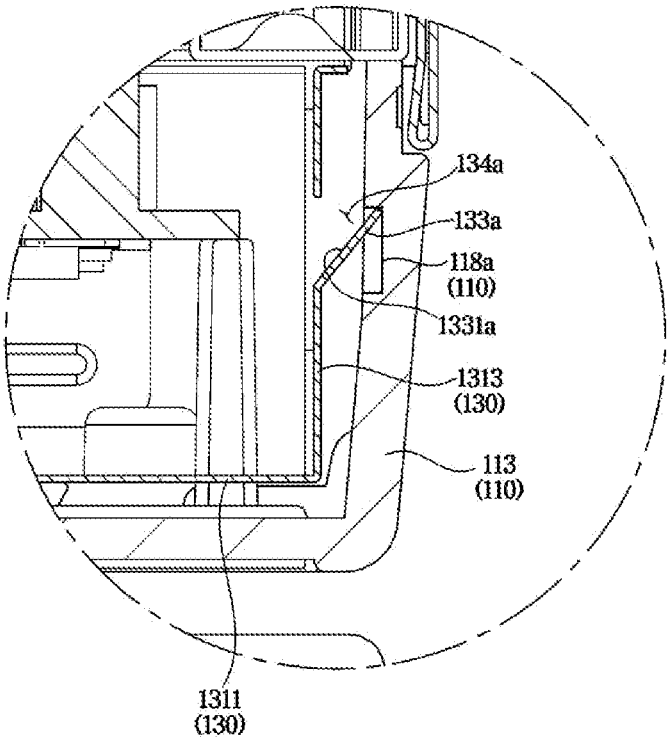
FIG. 20 is a cross-sectional view illustrating a state in which a case and a bracket panel of a cooking apparatus according to another embodiment of the present disclosure are coupled.

FIG. 20 is a cross-sectional view illustrating a state in which a case and a bracket panel of a cooking apparatus according to another embodiment of the present disclosure are coupled.

In the case of a cooking apparatus according to another embodiment of the present disclosure, only the shapes of the bracket panel and the case may be partially different from the cooking apparatus according to an embodiment of the present disclosure.

Therefore, the cooking apparatus according to another embodiment of the present disclosure may include the same configuration as the above-described cooking apparatus according to an embodiment of the present disclosure, and the same reference numerals may be assigned. Configurations not separately described may be provided identically to configurations of the cooking apparatus according to an embodiment of the present disclosure.

As illustrated in FIG. 20, the cooking apparatus according to another embodiment of the present disclosure may include a fixing rib 133*a* extending from the inner surface of the bracket panel 130 toward the case 110.

The fixing rib 133*a* may be provided to extend from the front of the bracket panel 130 to the rear. The fixing rib 133*a* may be provided to protrude outward from the bracket panel 130.

The bracket panel 130 may include a cutout hole 134*a*. The cutout hole 134*a* may be formed between the fixing rib 133*a* and an outer surface of the bracket panel 130.

Accordingly, a blocking portion 1331*a* of the fixing rib 133*a* may be provided to be inclined toward the outside of the bracket panel 130.

The fixing rib 133*a* may be pressed from the inside to the outside of the bracket panel 130 through lancing processing. As the fixing rib 133*a* extends from the inside to the outside of the bracket panel 130, an end of the fixing rib 133*a* may be supported by the case 110.

More specifically, the case 110 may include a rib accommodating groove 118*a* formed to be recessed into the inner surface of the case 110 so that the end of the fixing rib 133*a* is accommodated therein.

Through this, the position of the bracket panel 130 may be firmly fixed to the inside of the case 110.

In addition, as the fixing rib 133*a* is lanced to the outside of the bracket panel 130, a blocking portion 1331*a* may be formed on the outside of the bracket panel 130. Through this, the cutout hole 134*a* formed at an end of the fixing rib 133*a* may also be formed on the outside of the bracket panel 130. More specifically, the cutout hole 134*a* may be provided on the inside of the main body 10 in a direction opposite to a direction in which a flame spurts.

That is, the cooking apparatus according to another embodiment of the present disclosure also has a technical effect of preventing a flame occurred inside the main body 10 from spurting into the case 110.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a main body; and a control unit provided in front of the main body;

wherein the control unit comprises:

a case mounted on a front side of the main body and having an open rear side to communicate with an inside of the main body;

a bracket panel accommodated in a rear side of an inside of the case;

a protrusion extending from an inner surface of the case toward the bracket panel; and a fixing rib formed on a surface of the bracket panel to allow the protrusion of the case to be inserted, the fixing rib extending inward from an inner surface of the bracket panel and being positioned between the protrusion and the inside of the main body to cover a rear side of the protrusion.

2. The cooking apparatus according to claim 1, wherein the fixing rib comprises a blocking portion provided to face the inside of the main body so as to cover the rear side of the protrusion.

3. The cooking apparatus according to claim 2, wherein the fixing rib further comprises a connecting portion connected to both ends of the blocking portion and connected to an inner surface of the bracket panel.

4. The cooking apparatus according to claim 3, wherein the bracket panel comprises a cutout hole formed at a front end of the blocking portion to communicate with the case.

5. The cooking apparatus according to claim 2, wherein the blocking portion extends to incline forward from an inner side of a side wall of the bracket panel.

6. The cooking apparatus according to claim 1, wherein the fixing rib is pressed inward from a side wall of the bracket panel through lancing processing.

7. The cooking apparatus according to claim 1, wherein the bracket panel comprises:

a board accommodating frame in which a circuit board is accommodated; and a coupling flange extending upward from the board accommodating frame to couple with the case.

8. The cooking apparatus according to claim 7, wherein the board accommodating frame comprises a frame body provided parallel to a rear surface of the case and having a boss passing hole through which a board coupling boss extending to the rear side of the case passes.

9. The cooking apparatus according to claim 8, wherein the board coupling boss passed through the boss passing hole is provided to be screwed with the circuit board.

10. The cooking apparatus according to claim 1, wherein the main body comprises a front plate comprising an opening communicating with a cooking chamber and a communication portion communicating with an electrical equipment room.

11. The cooking apparatus according to claim 10, wherein the case and the bracket panel are coupled to the front of the communication portion of the front plate to cover the communication portion.

12. The cooking apparatus according to claim 11, wherein the electrical equipment room in which a cooling fan provided to form a cooling flow path is disposed is provided at a rear side of the communication portion.

13. The cooking apparatus according to claim 12, wherein the bracket panel is provided to cover the front of the communication portion and is disposed between the electrical equipment room and the case to partition the case and the electrical equipment room.

14. The cooking apparatus according to claim 1, wherein:

the case comprises a resin material, and the bracket panel comprises a steel material.

15. The cooking apparatus according to claim 1, wherein the case is configured to prevent a movement of the bracket panel by inserting the protrusion into an outer side of the fixing rib of the bracket panel.

16. A cooking apparatus including:

a main body, and a control unit provided in front of the main body, wherein the control unit includes:

a case mounted on a front side of the main body and having an open rear side to communicate with an inside of the main body, a circuit board, a bracket panel mounted to a rear side of an inside of the case to accommodate the circuit board, a fixing rib extending rearward from an inner surface of the bracket panel toward the case to protrude outward of the bracket panel, and a cutout hole formed between the fixing rib and an outer surface of the bracket panel, wherein the fixing rib is positioned between the cutout hole and the inside of the main body.

17. The cooking apparatus of claim 16, wherein the case includes a rib accommodating groove formed to be recessed from an inner surface thereof to accommodate an end of the fixing rib.

18. The cooking apparatus of claim 16, wherein the fixing rib is pressed outward from a side wall of the bracket panel through lancing processing.

19. A cooking apparatus including:

a main body including an electrical equipment room, and a control unit mounted on a front side of the main body to communicate with the electrical equipment room from a rear side thereof, wherein the control unit includes:

a case forming an exterior and having a protrusion on an inner surface thereof, a bracket panel accommodated in the case and including a cutout hole into which the protrusion is inserted, and a fixing rib formed by being pressed inward from a side of the bracket panel, the fixing rib being positioned between the protrusion and the electric equipment room and including a blocking portion provided to incline towards the front side of the main body from an inner surface of the bracket panel to form a space into which the protrusion is inserted.

20. The cooking apparatus of claim 19, wherein the cutout hole is formed at a front end of the blocking portion.

* * * * *